US012799418B2

(12) United States Patent
Makgeru

(10) Patent No.: US 12,799,418 B2
(45) Date of Patent: Nov. 17, 2026

(54) FUEL COMPOSITION FOR COMBUSTION

(71) Applicant: THE TRUSTEES FOR THE TIME BEING OF THE KMN FULFILMENT TRUST, Benoni (ZA)

(72) Inventor: Kabu Walter Makgeru, Benoni (ZA)

(73) Assignee: THE TRUSTEES FOR THE TIME BEING OF THE KMN FULFILMENT TRUST, Benoni (ZA)

( * ) Notice: Subject to any disclaimer, the term of this patent is extended or adjusted under 35 U.S.C. 154(b) by 0 days.

(21) Appl. No.: 18/292,326

(22) PCT Filed: Jul. 20, 2022

(86) PCT No.: PCT/IB2022/056686

§ 371 (c)(1),
(2) Date: Jan. 25, 2024

(87) PCT Pub. No.: WO2023/007315

PCT Pub. Date: Feb. 2, 2023

(65) Prior Publication Data

US 2025/0075140 A1 Mar. 6, 2025

(30) Foreign Application Priority Data

Jul. 26, 2021 (ZA) ..... 2021/05246
Aug. 17, 2021 (ZA) ..... 2021/05855

(51) Int. Cl.
*C10L 1/12* (2006.01)
*C10L 1/04* (2006.01)
*C10L 3/00* (2006.01)

(52) U.S. Cl.
CPC ..... *C10L 1/1233* (2013.01); *C10L 1/04* (2013.01); *C10L 3/003* (2013.01); *C10L 2200/024* (2013.01); *C10L 2200/0254* (2013.01)

(58) Field of Classification Search
CPC ..... C10L 1/1233; C10L 1/04; C10L 3/003; C10L 2200/024; C10L 2200/0254; C10L 10/02; C10L 10/10; C10L 2200/0423; C10L 2200/0438; C10L 2200/0446; B01J 23/002; B01J 23/745; B01J 35/40; F23K 1/00
See application file for complete search history.

(56) References Cited

U.S. PATENT DOCUMENTS

| | | | |
|---|---|---|---|
| 8,919,266 | B2 | 12/2014 | Johnson |
| 9,228,133 | B2 | 1/2016 | Liu |
| 2018/0179465 | A1 | 6/2018 | Ulrich |

FOREIGN PATENT DOCUMENTS

| | | | | |
|---|---|---|---|---|
| CA | 2611533 | A1 | 5/2009 | |
| CN | 1076717 | A | 9/1993 | |
| CN | 1091994 | A | 9/1994 | |
| CN | 102306818 | B | 1/2012 | |
| CN | 105733728 | B * | 11/2018 | ..... C10B 57/06 |
| CN | 105997944 | B | 7/2019 | |
| JP | 4934134 | B2 | 5/2012 | |
| RU | 2707276 | C1 | 11/2019 | |
| WO | 2018162208 | A2 | 9/2018 | |
| WO | 2020201937 | A1 | 10/2020 | |

OTHER PUBLICATIONS

Miceli. "Recovery/Reuse of Heterogeneous Supported Spent Catalysts" 1-17. Catalysts. Web. May 1, 2021; p. 7 paragraph 4; p. 8 paragraphs 4, 6 ;; DOI: https://doi.org/10.3390/catal11050591.
Santos-Durndell. "Magnetically recyclable nanocatalysts based on magnetite: an environmentally friendly and recyclable catalyst for esterification reactions" 806-812. Biofuel Research Journal. Web. 2018; p. 808 paragraphs 1, 6; DOI: 10.18331/BRJ2018.5.2.4.
Fauzi. "The effect of calcination temperature on the structure of iron oxide phase from west Sumatra" 1-7. Journal of Physics: Conference Series. Web. Sep. 4, 2020; p. 4 paragraph 3; p. 5, paragraphs 1-2; DOI. doi:10.1088/1742-6596/1876/1/012028.

* cited by examiner

*Primary Examiner* — Taiwo Oladapo

(74) *Attorney, Agent, or Firm* — Pacer K. Udall; Booth Udall, PLC

(57) ABSTRACT

A fuel composition for combustion according to claim 1, the fuel composition comprising a hydrocarbon-based fuel and magnetite material comprising magnetite. The magnetite material is in the form of powder with a size range from 1 nm-1 mm. The magnetite material is 0.1-80% wt of the fuel composition. The magnetite material comprises at least 40% magnetite ($Fe_3O_4$) and has at least 25% Fe (iron).

18 Claims, No Drawings

FUEL COMPOSITION FOR COMBUSTION

FIELD OF INVENTION

This invention relates to combustible material and specifically to a composition for combustion comprising a magnetite material.

BACKGROUND OF INVENTION

The principle of the combustion of fossil fuels is well known in the industry because fossil fuels are commonly used on a daily basis, and they are mainly hydrocarbon fuels that are the active elements in the combustion process. These fuels that are conventionally used which are fossil fuels may be liquid fuel e.g., petrol, diesel and paraffin, or heavy furnace oil; gaseous fuels, e.g., natural gas, methane, or LPG; or solid fuels, e.g., coal, wood, or anthracite.

In these cases, the combustion takes place because of the presence of carbon element. The carbon elements react with the oxygen gas in the form of the well-known process called reduction-oxidation reaction (REDOX reaction), The elements/materials that are involved in the redox reaction are "used up" in the combustion process, that is to say the carbon element involved in the combustion process, its properties of donating an electron are used up and it is converted into materials that cannot be used for the redox reaction anymore as above. Those resultant materials become a waste product from the combustion process. The main products of the conventional combustion process are heat, flame, ash, smoke, off-gases including greenhouse gases.

For the combustion process to proceed, three elements: (1) input heat, (2) carbon, and (3) oxygen are required to initiate and progress the combustion process. Air may provide $O_2$ molecule, the fuel maybe in the form of coal, which comes as a carbon element and the heat is provided to initiate and keeps the combustion on-going. The chemical equation for this reaction is:

$$\text{Heat}+C+O_2=CO_2+\text{Heat}$$

There are patent applications of which the inventor is aware which make use of magnetite for other applications, where the magnetite is calcined and converted into iron oxide and then mixed with other materials at certain proportions. WO2018052861A1 discloses magnetite ($Fe_3O_4$) utilised as a starting material; disclosed is a porous iron oxide absorbent with macropores. A composition of this iron oxide absorbent is made of magnetite, aluminium oxide, alumina silicate and a binder comprised of an organic substance. These materials are homogenised into a composition which is calcined in preparation for this use to burn away the organic matter and to make it suitable for application.

AT4132118 discloses a composition of 49-90% wt magnetite ($Fe_3O_4$), 60-70% saturated alkali earth silicate, 2-4% wt micro-silica, and 0.5-7.5% wt Al salt; the composition is silica bonded. This material may be used for heat storage, e.g., as storage blocks for night storage heaters for domestic uses.

TW200819618A discloses magnetite ($Fe_3O_4$) as part of a composition including Magnetite, Silica, Zeolite, Hydrotalcite, Ag, Pt, Cd, Ba, Zn, Ce, and $TiO_2$. These materials are mixed with clay and are processed further by calcining to produce ceramic composite material that enhances the efficiency of an internal combustion engine. In this application, the magnetite is used as a material to be a part of the structure of the engine to improve the internal combustion engine for better combustion efficiency of the combustion fuel for the internal combustion engine at the point of combustion process. The magnetite is not part of the fuel. The magnetite does not take part in the process of combustion in these inventions and there are publication where magnetite is mixed with metals such as Pt, Ag, tungsten, many steps such as annealing, temperature programmed desorption and nitric oxide exposure at controlled temperature is needed and sometimes under certain pressure. The magnetite looks like it performs under these complicated process steps and with very complicated and expensive metallic objects.

The Applicant desires a fuel composition for combustion which is relatively simple, inexpensive, remove the steps like Annealing and also remove the expensive metallic objects and in the process enhance existing hydrocarbon-based fuels properties.

SUMMARY OF INVENTION

Accordingly, to invention provides a fuel composition including a hydrocarbon-based fuel and a magnetite material comprising magnetite. More specifically, the invention provides fuel composition for combustion, the fuel composition comprising:

- a hydrocarbon-based fuel and magnetite material comprising magnetite ($Fe_3O_4$), wherein:

- the magnetite material is in the form of powder with a size range from 1 nm-5 mm;
- the magnetite material is 0.1-80% wt of the fuel composition;
- the magnetite material comprises at least 40% magnetite ($Fe_3O_4$); and
- the magnetite material has at least 25% Fe (iron).

DETAILED DESCRIPTION (SPECIFICATION)

Magnetite material-based fuel is a fuel where magnetite material is mixed with a fuel comprising fossil fuels or a Hydrocarbon fuels and other combustible compounds. Magnetite material is a material comprising of magnetite and different oxides, elements and other chemical compounds. The magnetite material may further specifically comprise the $Fe_3O_4$ (Magnetite), which is known as Magnetic iron oxide or Ferrous Ferric oxide, Phosphate, Pyrite, Silica, Alumina, Titania, Mn3O4, Cr2O3, V2O5, MgO, K2O, SrO, Na2O and ZrO2. The magnetite material in the fuel composition is 0.0025 to 65%, silica content is from 0.001 to 1.5%, the magnetite material has at least 40% $Fe_3O_4$ and the $Fe_3O_4$ has at least 25% Fe. The sizing of this Magnetite material is ranging from 1 nanometre to 5 mm. Magnetite material has a relatively high density and for applications in low density fuels such as Liquid fuels, the very small size is needed so that the magnetite material may float on top and within the Liquid fuel and also the reaction efficiency and rate of reaction becomes better at this 1 nanometre size. When the size of the material increases to 4000 nanometer or even 5 mm, the desired advantage is the heat generated during the combustion in a solid fuel is well distributed throughout the mixture and not contained in pockets within the mixture as the heat is needed to perform and this bigger size material improves the efficiency of the heat distribution. The other advantage of bigger sized is that handling and safety of this material becomes so much better. The Magnetite material may comprise oxides such as MgO at at least 3.5% and TiO2 at at least 2.4% which are also active in adsorption and reduction of the greenhouse gases. The magnetite material gives the fuel composition better fuel properties and imparts the fuel with dominant North pole or South pole and it also impart the fuel with Fe2+ and fe3+ charges. The raw magnetite material, the material has not been in a combustion process with a fuel has a dominant North pole and it makes this magnetite material based fuel to have a dominant North pole. The raw magnetite material may also have a dominant South pole and it makes the magnetite material based fuel to have a dominant South pole.

The combustion of this fuel may be in such a way that the magnetite material is a top layer of the fuel comprising solid fuel like coal during the combustion process. after the combustion of the coal with magnetite material, there will be a left over ash with solid magnetite material and this magnetite material combined with the ash may be used as a constituent part of the fuel and be added to reduce off gases comprising $CO_2$ from a combustion process of a fossil or hydrocarbon fuel as some of the ash acquires stronger magnetic properties when mixed with the magnetite material and therefore does not escape with the off-gases as is attracted to the magnetite material and therefore does not pollute the environment. The magnetite material combined with ash may be a new uncombusted magnetite material or a repeated burn magnetite material. When the magnetite material is at the top of the combusting coal. the magnetite material also makes the fuels comprising fine coal to gain some magnetic properties especially coal that has pyrite in it and this effect improves the combustion efficiency of the fuel.

This magnetite material may be used as an added material to combustible materials/fuels and these fuels comprising fossil fuels, hydrocarbon fuels, and opportunity fuels comprising solid fuels such as Coal, Wood chips, Run of mine coal, Charcoal, lignite, Sulphur material, Soot which is Carbon, Peat, Biomass, waste plastic material, wood pellets, Bitumen Liquid fuels comprising Heavy fuel oil, shale oil, Jet fuel, Diesel, Petrol, illuminating Paraffin, Naphta, Biodiesel, LPG, Methanol, Butanol, Gaseous fuels comprising Natural gas, shale gas, Propane, Hydrogen, Butane and Methane etc., for combustion process. for the Gaseous fuel when the fuel is released under pressure towards the combustion point, the magnetite material may be fed into the high pressure flow at a controlled rate so that it joins with the gas and become part of the composition of the Gas fuel. The opportunity fuels that can be mixed with the Magnetite material comprise of Petroleum coke, woody and Agricultural Biomass, tire-derived fuel and coal bed methane. Additional silica of at least nanometre particle size may be added to at least up to 1.5% silica ($SiO_2$) and this material is used as a Magnetite material based fuel since magnetite material is a very active compound in 20 this blended combination of different material. The magnetite material has metal oxides that help to reduce the greenhouse gases. The magnetite material is involved in donating and accepting of the electrons, it is involved in higher heat generation and is also involved in the reduction of the main off-gases, comprising $So_2$, No2, Co and $Co_2$ and it generates $O_2$ during the combustion process. The addition of silica which has a natural voltage is to improve the electrical field activity of the magnetite material and improve the overall combustion efficiency of the magnetite material based fuel. This enables the combustion of this Magnetite material based fuel material (Magnetite material, fuel and silica), increase the heat generation of the fuel, increase the pressure generated. This fuel reduces the particulate solid material released into the atmosphere. The magnetite material-based fuel achieves a prolonged combustion process, the silica may be of nanoscale sizing for certain applications such as liquid fuels.

The magnetite material, which has a high density and therefore for applications in liquid and gaseous fuels, it tends to settle due to its high density, but due to the presence of the other elements and compounds in the magnetite material, these other compounds and elements have low density compared to the magnetite Ferrous Ferric oxide and these other compounds may reduce the density of the magnetite material so that the magnetite material may be better suited to be blended with other fuels and this reduces the tendency of settling. The magnetite has at least 25% Fe (iron element). The magnetite material must at least be moisture free, that is it must have zero percentage moisture. Moisture in the material absorbs the heat energy generated during combustion process and therefore reduces the useful energy. The lesser the water/moisture in the magnetite material fuel the better the heat generation. This magnetite material has Magnetic field. This magnetite material has a dominant North pole. The North pole is more dominant than the South Pole for this material. For this material when the north pole is 2.2 milliTesla, the South pole reading may be 1.2 milliTesla or 1.5 milliTesla and in some measurements the South pole measures 0.7 milliTesla, and the magnetic field on the magnetite material in powder form has a magnetic field on the North pole of 0.460 milliTesla and the magnetic field reading on the South pole of 0.20 milliTesla. these measurements are for a Magnetite material which has not been combusted, but it is in powder form. The fine powder Magnetite material seems to respond differently compared to a solid magnetite material when subjected to a Magnetic pole. The raw magnetite powder material has a dominant North pole even if not subjected to a South pole. The magnetite powder material may be bonded with solid fuel using a bonding agent comprising a resin so that the magnetite material is covered with magnetite material all around or the magnetite material and the solid fuel or hydrocarbon fuel may be made into a structure like a pellet or ball structure where the magnetite material and the fuel are bonded with a bonding agent to form a structure comprising a pellet. The North/South pole has more influence on the activities of this material which is why it generates some unexpected technical outcomes and advantages. Material that at certain polarity reading will normally have equal magnetic field strength reading but opposite polarity reading, but this material does have this kind of property where the North pole is dominant, and it is dominant by a big margin in some readings by about 45%. These Magnetic readings may seem very small of the Magnetite material, but looking at the nanometer size, the effect is substantially appreciable. As the North pole dominate, the Magnetite Material generate more heat during combustion and when the Magnetite material is repeatedly utilized with fuels comprising fossil fuels and others, the Magnetic field strength reading of North pole is reduced and as it is reducing with repeated combustion, the heat generation is also reduced. And, as this magnetite material is repeatedly used for combustion process on Magnetite based hydrocarbon fuel, the more the South pole increases and the more it reduces the off gases including the greenhouse gases.

The magnetite material based fuel as a chemical product substantially solves the challenges that are posed by the hydrocarbon and fossil based fuels and other fuels by its chemical composition and Physical properties in terms of material compounds comprising magnetite, silica, Sulphur etc, by how the combustion process is initiated, by how the combustion process is maintained and by how the magnetite material based fuel end products are friendly to the environment and have sustainability due to repeatability of this Magnetite material product and that most of the end products after many repeat combustion may be utilized for use in industrial applications. One of the end products after repeated use of Magnetite material in this invention is that the magnetite material may end up as a haematite material ore which may be utilized in the production of steel. The more times the magnetite material is used in repeated combustion processes, the more it reduces the greenhouse gases and increases the $O_2$ from the combustion process. The magnetite material is recovered after the combustion process to be reused again. The conventional combustion process uses oxygen gas and at the end of the combustion process, there must be less oxygen than at the start of the combustion process, but in this invention the oxygen is not reduced, and, in some cases, it surprisingly increases. There may be no or less waste material from this invention during the combustion process. When the magnetite material is cooled (not hot), cooled after a combustion process to at most 35° Celsius. The magnetite material mixed with the hydrocarbon fuel for combustion it does reduce the greenhouse gases comprising $So_2$, No2, Co and $Co_2$. the times it goes through combustion, the better it reduces the greenhouse gases. This magnetite material for use in steel production may be blended with fuels comprising coal, coke, anthracite etc. and be fed on top of the mix so that it becomes the top layer and by so doing to start by reducing the greenhouse gases before it take place in the reaction process to form steel. This same above material may be used in other smelting processes for metallic smelting operations that can accommodate the iron (Fe) content in the production process and in the final product. Magnetite material, which as a fuel additive or added material to fuels has very desirable outcomes. As a fuel, it increases the heat generation, it can go through combustion repeated times, it reduces the off gases including the greenhouse gases, it is affordable, it is easy to transport, store and handle, so as an added material to a hydrocarbon fuel, the magnetite material based fuel it has very desirable characteristics as a fuel, Magnetite material introduces the good fuel characteristics in the magnetite material based fuel. These are the substantive features of the invention and are substantially removed from the prior art and from the conventional combustion fuels.

These particular properties of the magnetite material may be critical for this particular invention. The composition may have additional silica. Silica as a natural material has dielectric properties natural voltage and this voltage may increase the electrical activity of the magnetite particles and influence the magnetic and electrical properties. These properties of the magnetite material and silica may be very influential at a nanometre scale size. The fact that the magnetite material based fuel attains moderate ignition temperature may mean that the magnetite material based fuel does not need a lot of heat energy to start and propagate the combustion process and most of the energy generated is not used up by the process, it may be released for utilization. The other fact about energy is that the magnetite material has at least two electrons for donations and transfers. These two factors could account for the lager energy release. The magnetite material under this prevailing combustion conditions may donate an electron, accept an electron and donate an electron and this may happen at least twice which may account for the repeated use of this material in combustion process and this overall may end up with acceptance and donation of an electron and by so doing it may generate more soot than usual by its electrons converting the CO2 into CO and CO then into Carbon soot and Oxygen, and this Oxygen may be used to propagate the combustion process which may point to the fact that there may be a reduced need for atmospheric oxygen. The composition of this magnetite material and the combustion process creates conditions for this repeated donation and acceptance of electrons by the magnetite material.

The combustion process of the magnetite material-based fuel is different from that of the conventional fuels like the Hydrocarbon fuels. Hydrocarbon based fuels have a carbon element as an active element in the combustion process. The magnetite material as an active part of the fuel with carbon but it is different and is far removed from a carbon based fuel in how the reaction process and the left over products from the combustion process. The fact that the two, the magnetite material and carbon are involved in the chemical reaction could also account for the increased heat generation. The combustion process of the hydrocarbon fuel involves a Redox reaction chemical process. The combustion process of the hydrocarbon material is initiated by heat and is propagated by heat to progress further.

The Combustion Process

The Magnetite material-based fuel is more electrically charged and may have an appreciable electric field reading; it may therefore readily attract and readily accepts an electron. The magnetite in the magnetite material-based fuel may accept and donate electrons to chemically initiate the combustion process. The magnetite also donates its electrons to the oxygen element. The magnetite material may donate an electron to the $CO_2$ and the $CO_2$ decomposes into Co and then the carbon monoxide decomposes into carbon element and $O_2$, and the $Fe_3O_4$ may capture the $O_2$ from the $CO_2$, and this may be how the Magnetite material, reduces the amount of the $CO_2$ gas and also how it reduces other gases. The combustion process produced a lot of soot material which is in the form of flakes. A diesel which had magnetite material powder material generated more heat energy and reduced the off-gases and produced more soot in the form of small black flaky material at the same time and at the same time the $O_2$ level did not decrease during this combustion process which shows that the $O_2$ during the combustion process may be enough to maintain the combustion process or it may be released into the atmosphere. This $O_2$ is a by-product of this combustion process which involves magnetite material. This combustion process does not reduce the $O_2$ amount and in some cases, it increases the $O_2$ amount, which indicates that this combustion process generates some $O_2$. Some of the output from this combustion process of fossil fuel are more soot, more heat and more oxygen. The more soot was produced as the carbon material from the combustion process. The $CO_2$ is decomposed into carbon monoxide and then Co is then converted into Carbon which is the soot that is generated during the combustion process by the presence of the magnetite material. The donated electron may restore the Carbon as a Carbon element to a state where it may be combusted again. The magnetite material may donate an electron to the $CO_2$ and the $CO_2$ may accept this electron and this activity may release heat energy. So this soot material may form part of the new fuel and can be used for combustion purpose. This flaky black Carbon material may be used for many industrial applications such as made into pellets and used for smelting reduction applications. The more the $CO_2$ is decomposed the more the soot and oxygen are generated and therefore the original carbon material may be combusted a number of times under this operating conditions. The soot material may be recovered and blended with the magnetite material or may be combusted alone. It was clear from the test work that the dirtier the fuel comprising run off mine coal and heavy fuel oil, the more soot is produced and the less the $CO_2$ is produced, and it also produce more heat than when that same amount of material has no magnetite material. The magnetite material may be combusted repeated times and the carbon element may also be combusted repeated times and the two may be blended to form a new fuel material. This is a major technical advancement and a substantial improvement of the combustion technology. The repeatability of both the magnetite material and carbon element combustion work together to make the fuel a much more renewable and sustainable fuel and to have a substantial economic importance to the world economy. The difference and the benefits in this case are that the carbon element as a fuel has no other elements that form slag and ash and produce off gases such as NO and $SO_2$. this combined magnetite material and carbon element may the cleanest and the most efficient fuel for combustion process. The magnetite material increases the heat generation, reduces the off-gases including greenhouse gases and generates a cleaner carbon element which may be used for combustion process again and again. The soot material may be recovered and may be blended with the magnetite powder material and then this magnetite powder material soot may be blended with a hydrocarbon fuel for combustion process. The carbon in the fuel part of the magnetite material-based fuel donates an electron, in this combustion process the magnetite particle may accept an electron and then donate an electron and the oxygen molecule also accepts an electron, this act of accepting and electron release energy as the combustion process is in progress. This two-stage heat release give the Magnetite material-based fuel its high temperature combustion process. This two-stage or three stage if the electron donation to the $CO_2$ is factored into process gives this combustion process a unique chemical reaction to the magnetite-based fuel compared to other fuels. The reduction of the off gases comprising greenhouse gases happens during the combustion process.

The magnetite material because of its magnetic field and electrical field charges, this material tends to attract the fuel material comprising liquid fuel to its surface and this improves the maximum contact between the magnetite material and liquid fossil fuel. In a conventional combustion reaction process, one element (Carbon) in the form of may be Coal donates an electron and another element Oxygen molecule accepts the electron, and the reaction process is complete. In this invention, the Magnetite material may act as an intermediate between the initial electron donation and the final electron donation. The magnetite material may accept the electron from the hydrocarbon and then it may pass an electron to the oxygen molecule, or it may donate one of its own electrons. There are at least two stages of electron donations and there are at least two stages of electron acceptance activities. This two stage process may involve two different electrons, one from the carbon element and another from the magnetite material particle. The surprising effect is that Magnetite material particle acts as an electron acceptor and then as an electron donator and may also act as an electron donor and then accept an electron. This is a very unusual and surprising activity by magnetite material. That shows that the magnetite material may move from a higher level of electronegativity to accept an electron and then moves to a lower electronegativity to donate an electron to the next element which is oxygen molecule and may also donate to another magnetite particle, which improves its heat generation. When the magnetite material accepts the electron from the ignitor material which is a carbon based material, its oxidation state is reduced and it can get excited by its electrical field and by the heat of burning and also by the fact that it accepted an electron, this urges the magnetite material to donates an electron and then it becomes oxidized and increases its oxidation state. The magnetite material in the magnetite material based may provide a different route of the combustion process on the magnetite based fuel which uses less heat to effect the reaction and it generates much more Energy due to its ability to provide two stage electron donation. The electron from the Carbon element may prefer to be donated to the magnetite material due to the magnetite material electrical activity from its electrical charges and magnetic field. This situation of magnetite material accepting an electron and donating an electron may explain the longevity of the combustion process in the magnetite material-based fuel. The fact that magnetite material donates an electron during the combustion process, it acts similar to the carbon in a conventional hydrocarbon fuel and in addition it accepts electrons which act like the oxygen molecule in a normal combustion process. It does much more than a conventional fuel in relation to the movement of electrons.

The magnetite material acts more like a Catalyst in the combustion process. The difference of the magnetite material compared with a catalyst is that the magnetite material in the magnetite material based fuel loses some if its chemical properties and loses some of its physical properties. And in some respects, it enhances some of its chemical characteristics, because the more it is repeatedly used, the more it reduces off-gases including greenhouse gases. It does not act like a catalyst; it acts more than what a catalyst does in a chemical reaction. It improves some of its properties. It facilitates the process, goes through chemical/electrical changes and ends up as sometimes as a better magnetite material after the combustion process.

Some of these gases that are reduced are reduced by as much as 99%, which is much more superior. There is a table that illustrate how much of the off-gases from the combustion process are reduced. This is where a control sample off-gases released are compared to the off-gases of the same fuel amount with a magnetite material content. the magnetite material reduces these gases, which are four of some of the most climate damaging gases, unlike the conventional process where a number of material are used each to treat a certain gas as in the application of the limestone that reduces only one gas the $So_2$ and other materials must be sourced like Ammonia to reduce the $No_2$ and other material must be purchased to reduce the other climate change gases, compared to the Magnetite material, the other process of acquiring individual chemicals to reduce off-gases increases the costs of purchasing and handling these other material and they are inefficient. Magnetite material may also be added to the biofuels, especially biodiesel to among other benefits to reduce the Nitrogen oxide gas, as the biodiesel on its own generates NO, nitrogen oxide gas. The fossil fuels have Sulphur content in them, and it is well known that the magnetite material reduces the Sulphur gas from the fuel combustion. The other embodiment of this invention is when it is applied to the run of mine coal, which is the coal which is not treated yet. The magnetite material based fuel in this case comprises some untreated and uncleaned and unbeneficiated coal fuel which in the conventional process, it must be beneficiated. When the magnetite material is blended with this untreated and unprocessed coal, the off-gases including greenhouse gases are reduced except Carbon monoxide. Processing is a Metallurgical and Chemical treatment of material comprising coal to remove unsuitable material from the coal and make it more suitable for application for combustion process. Sometimes these processes are done to remove the greenhouse gases and increase the heat generation per unit mass of the fuel by 50%. The off gases comprising the greenhouse gases are reduced at differing rates. The CO2 may be reduced at 53% and the NO may be reduced at 64%. Some magnetite material composition in the magnetite material based fuel reduce certain off gases more than others. So certain off-gases can be targeted for reduction. The run of mine coal was tested. This run of mine coal-magnetite material-based fuel was used in a combustion process, the run of mine coal-magnetite material based fuel performance was much closer to a treated and beneficiated coal material. One of the undesired properties of the run of mine coal and other Power station quality coal is that they have low heat energy generation and release a lot of off-gases including greenhouse gases. But when the untreated, unbeneficiated and unprocessed coal was blended with the magnetite material and formed a magnetite material based fuel its performance improved both for heat generation and off-gas including greenhouse gas reduction. The Nitrogen oxide gas was 64% less than for beneficiated coal and the $Co_2$ was 53% less than for the beneficiated coal. So in some cases this run of mine coal-magnetite based fuel performs better than the beneficiated coal. The better performance of the unbeneficiated coal may be because of the high Sulphur content. The magnetite material nay be blended with Petroleum coke to reduce the Sulphur gases and the nitrogen as petroleum coke tend to have high amount of Sulphur and nitrogen. The magnetite powder material may be added and blended to opportunity fuels comprising Orimulsion, Bitumen, Shale oil, Oils sands, tire derived fuel, wood waste, agricultural waste, sawdust, postconsumer materials waste, biomass, woody biomass, plastic like (LDPE), Low density polyethylene and (HDPE) high density polyethylene, this plastic material are made from hydrocarbon and therefore tend to have high heat energy value and with the addition of magnetite material, the properties of these fuels can be improved to approach the processed fuel properties. The magnetite powder material may also be added to Anthracite, Graphite coke breeze to reduce greenhouse gases and increase the heat generation. This is the impact that the magnetite material-based fuel technology may have on the industries comprising coal beneficiation and comprising the fossil fuel industry and the waste fuel materials. Therefore, the magnetite material based fuel using untreated and unprocessed fuel comprising run of mine coal, untreated and unprocessed petroleum products may make the processing step, which is a step in the conventional processing of the conventional fuel unnecessary. The processing step of fuels comprising coal, petroleum fuels which are costly achieves smaller benefits compared to the addition of the magnetite material in terms of the reduction of gases comprising the greenhouse gases, heat generation and the cost. This addition of magnetite material to make the composition of the magnetite based fuel may eliminate this treatment and beneficiation step, it may cut off the associated costs and may make unsustainable and unprofitable waste material projects comprising coal, petroleum fuel projects more sustainable and profitable. It may even make waste coal dumps and coal slimes dams material more suitable as coals for combustion process. The unprocessed coal blended with magnetite material may perform better than processed coal without magnetite especially on some greenhouse gases and off-gases. This test work shows that the blending of magnetite material with the unprocessed fuel comprising unprocessed run of mine coal may remove some of the steps on the processing of coal. The purpose of treating and beneficiating materials comprising run of mine coal is to reduce the off-gases including the greenhouse gases and also remove the waste material and by so doing increase the heat generation of the coal and the value of the coal to the industry and society. By blending the run of mine coal and also the waste coal, slimes dam coal and unbeneficiated petroleum material etc, with magnetite material, the blending of the fuel with magnetite material performs the same activity as the beneficiation process in terms of the heat generation and off-gases reduction. This blending activity is a very simple step that may remove a conventionally accepted, complicated, water consuming, time consuming, electricity consuming, environment damaging and costly beneficiation process. The blending of the unbeneficiated slimes dams coal and waste dump coal with magnetite material performs a beneficiation activity. By making the slimes dams fine material and waste coal dumps to be of value to the industry, this may contribute to the cleaning of these slimes dams and waste dumps from the environment. There is a huge amount of slimes dam and waste coal material abandoned and other fuels all over the world, this could be become a source material for combustion process. The blending of the fuels comprising fossil fuels with magnetite material may substantially advance the mineral beneficiation technology of coal comprising slimes dam coal, waste dump coal and run of mine coal. The magnetite material may be blended with coal and coal derivatives and fuels which comprise coal, slimes dams coal material, run of mine coal, waste dump coal, Lignite, Peat, Anthracite, graphite, coke etc. The magnetite material based fuel where the Magnetite material is blended with a fuel comprising an unbeneficiated coal, waste fossil fuel material characterized in that the fossil fuel does not go through the full processing and beneficiation process and may only go through a partial processing, and this fuel is used for combustion process.

During the test work that the inventor did, it was observed that the magnetite material for combustion material process can be repeated many times over. The inventor repeated the combustion process several times on the same magnetite material sample with a new amount of fuel each time. The combustion process did progress as in previous cases and produced heat energy, but a little lower in the form of heat and off-gas reduction with the repeated combustion processes, even though the heat generation does get reduced noticeably from the 7th combustion repeat. Because of the many electron donation steps and acceptances, this process that involve the Magnetite material particle needs a lot of oxygen, more than usual to facilitate the combustion process.

One of the embodiments of the invention is its burning process. This burning process is in a fluidized bed combustion process where a lot of air is supplied to create a fluidized bed and also supply the oxygen needed or also to create a fluidized bed condition, the green-house gases may be fed into the reaction zone/chamber to create the fluidized bed condition and also to have them be reduced during the combustion process. This combustion process is where combustion fuel material is blended together with the magnetite material and then fed into a boiler or a combustion chamber. The blending material may be comprising at least a pulverized coal based fuel, maybe a fire lighter and may also be a liquid fuel such as petroleum based fuels materials and may also be a gaseous fuel. This process is then fluidized by pressured air blown from underneath and this process keeps the blended material in suspension for a better aeration of the fuel blend and for combustion and this bubbling fluidized bed generates more heat from the magnetite material-based fuel. A combustion test was done where the sample was blended with magnetite material and a comparison test was done with the same amount of magnetite material and fuel under fluidised conditions and the sample under fluidised conditions performed better on heat generation and on off-gases reduction. The fluidise condition during the combustion process generate at least 5% more heat and reduces the off-gases by at least 10% than when the combustion process is not in fluidised bed condition. As the magnetite material based fuel combustion process can be a repeated process. The continuous combustion is a practical way to benefit from the same magnetite material when blended with the solid, liquid and gaseous material. After the combustion process, the solid remainder of the magnetite material maybe left in the combustion area and only the hydrocarbon/carbon fuel be added in the correct proportion of the magnetite material based fuel to make up the fuel composition and this could be repeated at least twice. The magnetite material may be replenished or replaced when desired. There is a test work that was done with magnetite material composition in fuel from 0.32%-2.5% and the results in the reduction of the greenhouse gases was very good at more than 90% compared to when the magnetite material content is 40% of the fuel. At these lower content level, this may the most economic use of the material both in cost and in efficiency.

The repeatability of magnetite material for composition of the magnetite material based fuel for combustion is a very substantial improvement on the combustion technology. Not many chemical products like fuels can be combusted with repetition of the same material. One of the improvements on the combustion technology is when the magnetite material is combusted repeatedly which shows that it has an unusual unexpected technical advantageous outcome, this magnetite material is a versatile material where it has shown that the more times you burn it, the more it performs better in reducing the off-gases including the greenhouse gases, this shows that the more you burn it, the better it performs. That is to say that the magnetite material may reduce the off-gases including the greenhouse gases on the third repeated burn compared to the second repeated burn as shown by the test work. It is surprising enough that it can be combusted a number of times as a magnetite material with the fuel forming a magnetite material based fuel for combustion material but is far more surprising that it even performs better the more times you burn as part of the composition of the magnetite material based fuel. The more you gain benefit out of its combustion process, the more it becomes beneficial. It shows that the more you burn the more you prepare it for the next composition as part of a magnetite material-based fuel for combustion process to reduce the off-gases. This is a far more surprising technical outcome. The other unexpected technical outcome is that after the magnetite material has gone through a combustion process with a fuel, the magnetite material does not lose its magnetic properties as it happens with other magnetic material, where magnetic properties are lost when subjected to a higher temperature and the magnetic field influences the efficiency of the combustion process. The magnetite material may be regenerated for far more repeated use by the remagnetisation of this magnetite material, this raw magnetite material seems to be amenable to have a dominant North pole, so when this magnetite material is remagnetised, it may be remagnetised so that the dominant pole is the North pole and the South pole is not dominant pole, as the material with the dominant North pole may perform better on heat generation. As this material has a dominant North pole, the most efficient recovery of this material from coal burning where it will be mixed with ashes may be to use a strong South pole. The magnets used for this test were all of the same magnetic field strength and the same magnets were used for these tests. A magnetite powder material which was not magnetized had its magnetic field and its polarity tested and the North pole was on average 0.5 milliTesla and the South pole was 0.33 milliTesla. This magnetite material may also be magnetized by using the South pole only. A test was done where magnetite Powder material particles where subjected to a South pole from one side and then the magnetic field and pole tested, and the North pole was on average 1.26 milliTesla and the South pole was negligible and sometimes only the North pole was detected. Another test was done where the Magnetite powder material particles were subjected to South pole on both (all around) the opposite sides and the measured Magnetic field on both sides was North pole as expected and one side had an average reading of 1.06 milli Tesla and the other side had an average reading of 1.39 milliTesla. another embodiment is where the magnetite material may be subjected to a South pole all around so as to make a North pole dominant magnetite powder material with higher North pole magnetic field reading to make magnetite material based fuel with a North pole, and another embodiment where magnetite powder material is subjected to a North pole all around to make magnetite material based fuel with a higher South pole magnetic field reading to be used for combustion process. So, the magnetite material may be treated to have a higher North Pole reading which is very suitable for improving the heat generation Another test was done where the Magnetite powder material particles were subjected to South pole on one side and North pole on the opposite side, the Magnetic field measured on both sides was surprisingly North pole and one side measured on average 0.92 milliTesla and the opposite side measured 1.53 milliTesla. Another test was done where the Magnetite powder material particles was subjected to North pole on one side and the other side had no magnet and the measured Magnetic field measured on both sides were South pole and the measured magnetic field on the side closer to the magnet was 1.54 MilliTesla and the opposite side was 0.67 milliTesla. most of the tests indicate that the North pole is the dominant polarity but, in some instances, the South pole was very evident for raw untreated powder magnetite material. The above combinations of polarities may be used to remagnetise the magnetite powder material to a level and polarity which is needed as North pole on the magnetite powder material increase heat generation and South pole on the magnetite powder material reduces the off-gases including the greenhouse gases. When the raw magnetite material is blended with a fuel comprising a hydrocarbon fuel and do a combustion process, the South pole increase with the combustion process while the North pole decreases with the combustion. One of the embodiments of the invention is to burn the magnetite material based fuel and then recover the magnetite material and then get it milled finer may be from 45 micron to may be 50 nm than it was before the burn so as to expose the previously unexposed surface of the magnetite material and blend it with a hydrocarbon fuel to make a magnetite material based fuel for better combustion process and then remagnetise it. One other embodiment of the invention is in the processing of the Magnetite material to prepare it for mixing with hydrocarbon fuels combustion process. the magnetite material may be allowed to cool, When doing the repeat burns on the magnetite material, if the magnetite material from the previous combustion is allowed a slow cooling of at least one hour between the burns, the magnetite material based fuel performs better than when the magnetite material based fuel is used within an hour after the previous burn. This resting period of about an hour in air is essentially a cost effective cooling activity where the material achieves an temperature not more than 35° C. For repeated combustion the magnetite material based fuel may be combusted and the thereafter the solid residue magnetite material is recovered, after recovering it, it is allowed to a rest period for an hour to cool the material to atmospheric temperature and then it is blended with a hydrocarbon fuel for another combustion where the performance of the second combustion burning process is better that the first combustion process in terms of the reduction of off-gases comprising greenhouse gases. One of the best performing embodiments is when the material is cooled with lower temperature. The cooling process is when the magnetite material is allowed to lower its temperature. When the magnetite material for this application is cooled with a lower temperature of at most about 35 degrees Celsius such that this material achieves at most the 35 degrees Celsius and when that magnetite material is blended to form a Magnetite material based fuel, the magnetite based fuel treated this way gives a better performs in terms of heat generation and off-gases reduction compared to magnetite material that is at a temperature of above 35 degrees Celsius. The lower the temperature used for cooling the magnetite material to make a magnetite-based fuel, the better it performs. If you compare a magnetite material cooled in a 35-degree Celsius temperature, where the magnetite material reaches 35-degree Celsius temperature and the magnetite material cooled in a temperature of about 5 degrees Celsius, where the magnetite material reaches 5-degree Celsius temperature, this magnetite material in magnetite material based fuel treated with lower temperature performs better than magnetite material in a magnetite material based fuel treated with higher temperature. The cooled magnetite material seems to react more with off-gases comprising $CO_2$, CO, $SO_2$, NO and it reduces more of these gases. The cooled magnetite material based fuel for some test samples achieved a reduction of off-gases efficiency of 84%. This cooling process of the magnetite material may be repeated at least twice to gain full benefit from the cooling activity. The magnetite powder material is blended with the hydrocarbon/fossil fuel and together cooled for use in a combustion process. The other embodiment of the cooling activity is when the magnetite powder material is blended with the hydrocarbon/fossil fuel and this fuel is cooled and subjected to a magnetic field for use in combustion process. The repetition combustion embodiments may be combined such as when the magnetite material after combustion is milled finer and then cooled and then blended into a magnetite material based fuel. The recovery of the magnetite material may be done by utilizing its magnetic property whereby the magnetic separator is used to recover the magnetite material after the combustion process. The magnetic separator selectively attracts the magnetite material particles as the have magnetic properties and separate them into a separate container for further repeated use. the magnetite material may also be cooled and blended with a liquid fuel and the liquid fuel to be decanted to make a magnetite material-based fuel for use in combustion process. The other embodiment of this invention is that the magnetite material-based fuel as a whole may be cooled and then after the cooling process be used for combustion process.

The other embodiment of the invention is characterized by the composition of the magnetite based fuel where the performance of this fuel does not consistently increase linearly with the linear increase of the magnetite material content of the magnetite material based fuel. The magnetite material used for this is of at least a nanometre particle size, during a test work it was observed that when the performance of this magnetite material based fuel diesel at 52% magnetite material content increases the heat generated by 30% compared to no magnetite material content in the fuel and reduces some of the off-gases including the greenhouse gases, Nitrogen oxide decreases by 85%, when the magnetite material content is decreased to a level of 40% magnetite material content, surprisingly the performance benefits in terms of the reduction of the off-gases are low at 72%, or when magnetite material concentration is increased by 30%, the off-gases reduction improves by only 18%. The performance does improve by 18% or in a linear manner. The increase of the magnetite content is 30%, but the improvement is not linear increase as it improves by only 18%. Certain magnetite material content reduces the greenhouse gases at different rates. The magnetite material may be blended with Heavy fuel oil to make a magnetite material based fuel for use in combustion process and as Heavy fuel oil is very heavy, it may not have a challenge of the sinking of magnetite material, and it will be very suitable for the blending with magnetite material as it may not need any decanting preparation as the magnetite material may achieve uniform blend or may be on top of the heavy fuel oil. For heavy fuel oil, at 50% magnetite material content. nitrogen oxide is drastically reduced by 65%. But unpredictably when you decrease the content in magnetite material based fuel like the Heavy fuel oil to 0.32% magnetite material content in the magnetite material based fuel, the performance on off-gas reduction is much more superior outcome with a reduction of some gases like No gas which is reduced by as much as 98%. It would be expected that when the magnetite material is increased, the reduction in off-gases will be increased, but is observed with this test work, the much lower magnetite material content in the magnetite material based fuel generates a much bigger performance of the reduction of the off-gases as can be seen with the Nitrogen oxide. So the consistent linear increase in magnetite material content in the magnetite material based fuel does not consistently bring a consistent linear increase in performance in terms of the heat generation and off-gases reduction including greenhouse gases. The magnetite material in the composition of the magnetite material based fuel may be more efficient at certain % composition. Some magnetite material percentage content in the magnetite material-based fuel generates very small amount of improvement which looks like a dead-end and sometimes no decrease of the greenhouse gases at all. The magnetite-based fuel may have a dosage of Magnetite material of as low as 20 ppm and the silica dosage may be as low as 10 ppm. In some cases, some of the higher magnetite content bring a negative outcome in that it does reduce the performance of the magnetite material-based fuel on off-gases reduction. This seems like a dead end for use of this magnetite material, but at another increased dosage the performance improves. So the selection of the magnetite material percentage content in the magnetite material based fuel composition is not predictable for heat generation and greenhouse gas reduction. It does not follow a linear relationship, meaning that if 10% content of magnetite material make a 20% improvement, it does not follow that 20% content make 40% improvement. There is a Research paper that highlights that the addition of magnetite beyond 10% brings no improvement to the fuel performance and but this proposed invention shows that addition far beyond 10% do improve the performance of the fuel. This publication seems to teach away from adding any magnetite material beyond 10% to make Magnetite material based fuel and this brings along a no expectation of success when adding beyond 10% magnetite material to make a magnetite material based fuel. For the heat generation, a comparison was made with a diesel control sample and a sample with magnetite material content and a cooled sample. The control sample with no magnetite material for comparison had a temperature reading of 236 degrees Celsius during combustion and a sample with 0.125% magnetite material content had a temperature reading of 313 degrees Celsius which gives an improvement of 33%. Cooling and repetition gives an improved reduction in off-gases and they actually work together to give a synergistic superior off-gases reduction. The magnetite material based fuel may have a composition comprising 85% magnetite material. The magnetite material-based fuel generates more heat than a conventional fuel without magnetite material, especially when is in a fluidized bed formation as it needs more air and oxygen. The other material which generates more heat that may be utilized as the ingredient composition part of the Magnetite material based fuel is Sulphur. In this embodiment the magnetite material based fuel may comprise hydrocarbon fuel, Sulphur material and magnetite material. The function of the Sulphur will be to generate additional heat and the magnetite material will generate more heat and also reduce the $SO_2$ from the Sulphur material from the magnetite material based fuel. For the Sulphur material, the fuel may start with Sulphur element or as a compound, and this Sulphur will go through a combustion process and normally, the $SO_2$ should be produced, but for this magnetite material based fuel, one of the materials produced may be the Sulphur as the $SO_2$ is decomposed into Sulphur and oxygen. This embodiment comprising Sulphur opens a new way and a new type of fuel which may bring a huge amount of heat generation per kilogram of the fuel. The composition of this embodiment of the invention may have at most 5% Sulphur content and once again the Sulphur may be used again and again. The embodiment of this invention may also be used in the firelighter and in the firelighter matchstick the sulphur is blended with the magnetite powder material so that when the firelighter burns it burns with magnetite material and increases the heat generation and reduce the $SO_2$. This application may also be extended to the firelighters, so that when the fire starts at the tip of the firelighter or at the block of firelighter the magnetite material is forming a part of the firelighter fuel composition. The other embodiment of this invention is when the magnetite material is used as part of the structure or as conduit of the oxygen lancing pipe for the tapping of Furnaces, this is because the magnetite material improves the heat generation in the combustion area. In this application all the thin wires within the oxygen lancing pipe may have magnetite material blended within the structure of the wires and in the piping material. The magnetite material may also be used in the hot springs and natural geysers and geothermal wells which release gases comprising $SO_2$ and $CO_2$ into the atmosphere. The Hot springs emit methane and geothermal wells emit methane gas and CO2, a. In geothermal wells, Geysers and hot Springs the magnetite material may increases the heat release and reduce the off-gases and the heat may be used for heating application or for Power Generation. The other embodiment of the invention is to apply the magnetite material blended with methane gas for flaring off the methane gas. The flaring of methane gas generates a lot of greenhouse gases. In the case of Methane flaring, the methane gas must be captured, and its escape speed/pressure slowed and then be blended with magnetite material or the combustion of the methane gas happens in a magnetite material environment and this could generate more heat and be used for Electric Power generation or for domestic heating purposes or it may just be flared and reduce the methane into the atmosphere and also reduce the greenhouse off-gases. The flaring of methane gas happens in coal mining and petroleum producing regions adding to the pollution with methane gas itself and the combustion off-gases. The treatment and blending of methane gas with magnetite material may be very critical as methane gas is the most potent gas in affecting climate change negatively. The cutting torch tip where the flame comes out may have magnetite powder material as part of the structure so that where the combustion starts, and the flame comes out the magnetite material becomes part of the combustion process to increase the heat generation and reduce the off-gases including greenhouse gases. The magnetite material may be blended with the waste coal to reduce the off-gases which comprises $CO_2$, CO, $SO_2$, NOX and this is in case the waste dump self-ignite, the off gases will be reduced. Also if the waste coal is already in combustion, magnetite material may be fed/blended/poured over the already burning waste coal. The development of Underground Coal Gasification and underground combustion where the coal does produce gases like $CO_2$, and CO the magnetite material may be mixed and pumped into the in-situ coal for combustion process so that the magnetite material reduces the off-gases including the greenhouse gases. This mixing of magnetite material by drilling holes into the coal seam and pumping/feeding magnetite material into these seams to make a magnetite material based fuel may reduce the off-gases and also reduce the need for carbon capture underground. This may be an opportunity for the industry on climate change to make a major impact by using stored $CO_2$ where magnetite material is blended with the burning fuel and stored $CO_2$ and the magnetite material is reacting with the $CO_2$ to decompose the $CO_2$ into CO. In this case much more Oxygen in the form of air must be supplied. $CO_2$ may be introduced carefully into a combustion activity where magnetite material is blended with a hydrocarbon fuel, whereby the magnetite material may react with the $CO_2$ and decompose it into CO and finally the CO may decompose into Carbon and oxygen. the way the magnetite material works is that the $CO_2$ reacts with the magnetite material after the $CO_2$ was formed from the combustion process. This process may be used where the carbon storage, where the stored carbon dioxide ($CO_2$) is blended with magnetite material and then blended with a fuel for combustion activity. The $CO_2$ may be in a liquid or solid form and then be blended with magnetite material and then blended with a fuel for combustion process. A similar process may be done with CO and be used in a combustion process. The same process of blending the magnetite powder material with a hydrocarbon fuel/fuel and then blend with $SO_2$ for a combustion process. A similar process as above where same process of blending the magnetite powder material with a hydrocarbon fuel/fuel and then blend with NO for a combustion process. The other embodiment of this gas addition is when the magnetite material may be blended with a hydrocarbon fuel and then blended with the gases comprising at least $CO_2$, CO, $SO_2$, $H_2S$, Mercury and NO.

the magnetite material-based fuel may be blended with $FeS_2$ which is applied for a combustion process. The magnetite material may also be applied and blended with material comprising flammable ice, permafrost etc. which is a gas hydrate of methane gas, and the permafrost may be a frozen soil or rock with methane gas to increase the heat generation and reduce the greenhouse gases during combustion. The waste oil may also be blended with magnetite powder material for combustion process. This invention may have an embodiment in a ferroalloy smelting process or any process where the reduction uses the material comprising coal, where the magnetite material is blended with the reductant material comprising coal, coke, graphite, Anthracite material, where the magnetite material may increase the heat generation of the process and also the magnetite material will reduce the off-gases including the greenhouse gases. Because this product is the Ferro-alloy material, the additional iron Fe content may still be acceptable. the Ferro-alloy product may comprise ferrochrome, ferro-silicon, ferro-vanadium, Ferromanganese, ferrophosphorus etc. the magnetite material based reductant may be fed on top of the $Fe_2O_3$ so that the magnetite material reacts with the off gases and then becomes part of the iron making process by contributing the Fe element.

One of the challenges of magnetite in a liquid fuel is that most of the magnetite material tends to sink to the bottom of the liquid fuel and therefore end up as an inconsistent fuel. A much more uniform and consistent composition of the fuel is desirable. Also, the magnetite material is more effective and desirable when it is on top of the surface of the fuel. One of the effective ways to solve this consistency problem is to mill the magnetite material to a nanoscale particle level, so that most of it floats on top and within the liquid fuel. When most of the magnetite material floats within the liquid fuel, it increases the density of the liquid fuel and by so doing the fuel becomes viscous and the magnetite material particles do not sink easily, they are kept in suspension, this activity may make the fuel to have consistent composition. The other way to solve it is to use surfactants that keeps the magnetite particles afloat so that the combustion process is consistent.

There were tests done on the invention.

Test on Coal: The test work was done with solid fuel comprising Coal where each of the Coal samples were blended with Magnetite Material Powder and it was observed that the Coal-Magnetite material based fuel blend does burns hotter and the combustion process last longer compared to Coal on its own. The flame was also much bigger than the flame for coal on its own. For the results of the off-gases, No2, $So_2$, Co and $Co_2$ were measured for comparison. These off-gases were reduced. A test was also done with Liquid Fuels comprising Diesel, Petrol and Paraffin. In this test the Magnetite-powder material Liquid fuel blend (Diesel) test showed that the Magnetite powder material-Diesel Blend was performing better than a Diesel alone, the Magnetite powder material-Diesel Blend was performing better on heat generation, the flame was bigger, and the combustion process lasts longer. The combustion process lasts about 5 times as long with stoking of the fuel sample with magnetite powder material and the temperature is far more than that of the Diesel on its own. For a test that was done, a comparison test was done with same amount of diesel, where the diesel alone was combusted and the average temperature was 142 degrees Celsius for this test and another test was done with the same amount of diesel blended with magnetite material and the average temperature was 329 degrees Celsius, which indicated more than 100% improvement and the combustion process of the magnetite powder Material-Diesel lasted longer. The diesel alone combustion test lasted 30 seconds and the magnetite material diesel blend lasted about 150 seconds, the flame was twice as big.

The other embodiment of the invention in terms of the hydrocarbon fuel is that the Liquid fuel maybe conditioned with cooled Magnetite material in a container (tank) surrounded by cooled Magnetite powder material layer for a certain period, this is a container that has a middle layer of cooled or not cooled magnetite material located in the inner layer of the solid container material made of plastic material comprising polyester material and other plastic like materials and the magnetite material make contact with fuel and the magnetite material is loosed with use from the container and becomes part of the fuel during the combustion stage. and that Magnetite powder material-based fuel from the container can be used for combustion process. This embodiment could among others be in the form of fuel tank for an automobile, fuel storage tanks and fuel transportation tanks that is where fuel is contained, even the fuel delivery system in an internal combustion engine including even the pumping system may be made with the magnetite powder material or even pipes through which the fuel is pumped through. Any part of the fuel delivery system that comes into contact with the fuel may be made with this cooled magnetite material or magnetite powder material which is not cooled in its structure. The magnetite material may also be blended with a suitable rubber material to make the structure for the delivery of the hydrocarbon fuel. The pumps in any fuel pumping system may be made with magnetite material that is loosed with use to form part of the fuel. it may also be any fuel containment. The magnetite powder material may be blended with the bitumen which may act as a binder to be blended with other fuels comprising solid hydrocarbon fuels. Another embodiment of this containment may be in that the cooled magnetite material powder may be formed into a container shape by using a binder material comprising bentonite where the cooled magnetite material is bonded into desired shape where the outermost surface of the container is made of material comprising metallic material and the inner surface is made of cooled or not cooled bonded magnetite powder material where the liquid fuel or even solid fuel is in contact, touching contact with the magnetite material. Train fuel containers, Ship fuel container, LPG containers, fuel pipe for the pumping of fuels, long distance fuel transportation pipes for containment of the fuel. even small domestic level fuels containers like jerry cans, paraffin tanks may use the embodiment where magnetite powder material is part of the structure of the magnetite material gets loosed with use to form part of the fuel. The other embodiment may be where the cooled or not cooled magnetite material is uniformly mixed with the material comprising concrete, metallic material, the plastic material comprising Nylon, Polyester etc may also be used. the other embodiment may be when the structure of the containing material is blended with magnetite material such that the magnetite powder material is gradually gets loosed from the structure with the flow of the fuel and use over time and the magnetite material joins with the fuel on its way to the combustion point. This is when the magnetite material peels away in small particles and become part of the hydrocarbon fuel. The Fuel Technology development space is a highly crowded space partly due to environmental requirements where the gases produced from fossil fuel are causing climate change. After the combustion process of the Magnetite material, a number of repeat combustion tests were conducted on the same Magnetite material and it kept on burning and each combustion test generated good heat, even though the heat generation was minimally reducing for each successive combustion process at the eighth combustion test the heat generation is reduced at a noticeable rate. After each combustion test, a test was done to check how Magnetic is the combusted Magnetite material sample and it was found that the Magnetic field is reducing with each combustion process as measured with a Tesla meter, where the Magnetite material is converting into hematite iron ore. The one measurement test was done before the combustion with a reading of 0.8 milliTesla and after the combustion the tesla reading was 0.7 milliTesla, this shows a decrease of about 12.5%, and there were other tests showing the changing magnetic field on the magnetite material of 3%, some showing 5%. it is a well-known fact in the fuel industry community that the fuels comprising liquid fuels do not have any polarity, that is there is no South pole and North pole. A reading of magnetic field strength was also taken on this diesel fuel with a high precision tesla meter, and it was observed that the fuel has a small consistent polarity reading. This polarity is characterized by a persistent and dominant South pole, but very small reading. Now taking into account that the magnetite material has a dominant North pole, and the two materials are blended together for the combustion process. This suggest that the magnetic field from both the two material may have an influence on the combustion and heat generation, the magnetic field from the two blended materials work synergistically together to improve the performance of the fuel in terms of the heat generation and off gases reduction including the greenhouse gases. the magnetite material does not fully act like a catalyst, as a catalyst remains chemically the same after the reaction with a physical change. Some of the magnetite material changes into haematite. The magnetite material for this application experiences both the Physical and Chemical changes. The physical changes could be as a result of the misalignment of the magnetic particles during the combustion process which may result in the reduction of the magnetic field especially on the North pole. But the south pole keeps on increasing with each combustion process when the magnetite material based fuel is used, but the south pole strange enough does lose or get reduced. The magnetite material can be remagnetised to increase its magnetic field to a higher level.

The magnetite material comprises fe2+ and fe3+ and during the combustion of the magnetite material based fuel, there is an increase of fe2+ which decreases the combustion off-gases comprising the Co, Co2, So2 and No2 and there is a decrease of fe3+ during the same combustion process which decreases the heat generation, the fe2+ is increased and it also keeps on increasing the more times you repeat the combustion process. And also, at the same time the fe3+ keeps decreasing in the same material the more times you do the combustion process on it. during the combustion process, the fe2+ increases and the fe3+ decreases and improves the performance of off-gases reduction. The start of the combustion process prepares the magnetite material for further combustion activities for gas reduction. The magnetite material may be prepared by a combustion process for the further combustion process to form a magnetite material based fuel. When cooling the magnetite material in preparation for blending with a fuel for combustion process, the fe2+ content increases and also the fe3+ content decreases. Cooling means lower the temperature from after the combustion temperature. The cooling of the material may be performed at a temperature down to −15 degree Celsius and even lower temperature. The cooling process may also be a slow cooling process. The fe2+ increases from about 24% by mass and the fe3+ decreases from 76% by mass. The increases of fe2+ during combustion process is increasing by about 10% and the decrease of fe3+ is decreasing by about 3%. The cooling action increases the fe2+ by at least 10% and the fe3+ decreases by at least 3%. A method of preparation of the magnetite material based fuel where the magnetite material is subjected to South pole and the North pole magnetic field is increased and becomes dominant and the fe3+ increases and this improve the heat generation, the fe3+ and North pole work together to improve the heat generation in a much superior manner and a similar embodiment where the magnetite material is subjected to a North pole and the South pole magnetic field reading is increased and becomes a dominant pole and the fe2+ is increased and improves the off-gases reduction, the fe2+ and the South pole work synergistically together to reduce the off-gases comprising co·co2, so2 NOx in a much more superior manner. So, the repeat combustion process with cooling action improves the off-gases reduction efficiency, and the two of them work synergistically together to improve the performance of the combustion process. the repeated combustion, cooling and subjecting the magnetite material to magnetic field also work synergistically together to improve the overall performance of the magnetite material based fuel. After the combustion of magnetite material based solid fuel where the solid fuel is comprising coal, the ash and the fly-ash becomes magnetic and therefore does not easily become air-borne. Unburned magnetite material may be blended with ash and this blended material can be blended with the fuel for combustion process. The fly-ash and the magnetite material together have magnetic field strength reading. This fly-ash and magnetite material blended with coal was able to reduce the off-gases comprising Co, Co2, So2 and No2 a little better than the magnetite material alone. The fly-ash and magnetite material after combustion has a dominant North pole which is bigger than when magnetite material is on its own. Carbon can be magnetized at room temperature and therefore the carbon material which has not gone through the combustion process and the one that has formed a soot may be recovered with the magnetite material and be used for combustion again. The magnetite material based fuel also reduces particulate matter.

Tests on Candles: A test was also done with two candles where one candle was an ordinary candle with a wax while another was with Magnetite material in the wax. The magnetite material content in the magnetite material based fuel (wax) was at most 80% magnetite powder material content as 80% works better for a candle structure and the flame of the candle. The composition of the Magnetite material wax may have other waxes comprising beeswax, soya wax, vegetable or coconut, olive wax, animal fat waxes etc apart from the paraffin wax. Stearic acid may also be added. In conventional paraffin candles 1 gram of candle generates 2.8 grams of $CO_2$. The magnetite material in the wax may reduce the Co and $CO_2$ by up to 75%. The other gases such as $NO_2$, $SO_2$ are also reduced by the same margin, this proposed invention embodiment candle generates higher temperature during its combustion is also brighter. This candle with a bigger, brighter, hotter, long lasting flame may be used for heating, lighting and cooking applications. The repeated magnetite material may be used to make the candle with smaller flame because repeat magnetite generates less heat. The candle with Magnetite material wax burns much brighter than the ordinary candle as well, at more than 30 lux and light up a bigger area, which shows that for the Lighting market this candle may solve the problem of smaller light, of cost, off-gases including greenhouse gases that are damaging for health and environment. This combustion process also increases the 02 gas which is better gas for the environment and health. The heat of the candle blended with magnetite powder material are at least 25% bigger than the conventional candle, brightness of at least 30 lumens and increases the scent from the candle by at least 10%.

Test Results

Diesel Fuel Test Results with Magnetite Material:

| Gases Tested | No Magnetite Material | 52% Magnetite Material | 5% Magnetite Material | Cooled Magnetite material at 50% |
|---|---|---|---|---|
| NO (ppm) | 32.13 | 4.95 | 23.39 | 5.00 |
| $SO_2$ (ppm) | 37.81 | 10.38 | 40.86 | 19.6 |
| CO (ppm) | 2323.52 | 1096.72 | 2738.48 | 1632 |
| $CO_2$ (%) | 4.61 | 3.81 | 5.11 | 4.56 |

Paraffin Fuel Test Results with Magnetite Material:

| Gases Tested | No Magnetite Material | 40% Magnetite Material | 10% Magnetite Material | 1.25% Magnetite material |
|---|---|---|---|---|
| NO (ppm) | 10.4 | 4.11 | 6.28 | 1.25 |
| $SO_2$ (ppm) | 168.73 | 75.88 | 90.28 | 1.62 |
| CO (ppm) | 4444.64 | 3275.27 | 3931.48 | 1623.43 |
| $CO_2$ (%) | 7.18 | 6.16 | 6.17 | 3.36 |

Coal Fuel Test Results with Magnetite Material:

| Gases Tested | No Magnetite Material | 50% Magnetite Material | 40% Magnetite Material | 30% Magnetite material |
|---|---|---|---|---|
| NO (ppm) | 40.96 | 0.05 | 11.38 | 83.15 |
| SO2 (ppm) | 176.75 | 9.91 | 27.72 | 43.04 |
| CO (ppm) | 3834.16 | 662.3 | 1755.57 | 386.57 |
| CO2 (%) | 1.86 | 0.15 | 4.17 | 3.37 |

Run of mine (ROM) Fuel Test Results with Magnetite Material:

| Gases Tested | No Magnetite Material | 20% Magnetite Material | 1.25% Test Magnetite Material | 0.63% Magnetite material |
|---|---|---|---|---|
| NO (ppm) | 56.34 | 13.86 | 14.89 | 21.94 |
| SO2 (ppm) | 237.07 | 232.83 | 217.38 | 214.55 |
| CO (ppm) | 2681.5 | 3341.18 | 3304 | 4105.54 |
| CO2 (%) | 2.51 | 0.85 | 0.88 | 1.24 |

Heavy Fuel Oil Test Results with Magnetite Material:

| Gases Tested | No Magnetite Material | 50% Magnetite Material | 40% Magnetite Material | 0.32% Magnetite material |
|---|---|---|---|---|
| NO (ppm) | 28.75 | 10.0 | 28.16 | 0.49 |
| SO2 (ppm) | 11.6 | 26.53 | 2.46 | 29.12 |
| CO (ppm) | 541.01 | 1.31 | 461.05 | 1.4 |
| CO2 (%) | 2.83 | 1.67 | 2.49 | 0.22 |

Repeated Diesel Fuel Test Results with Magnetite Material:

| Gases Tested | First Test with Magnetite Material | Second Test Magnetite Material | Third Test Magnetite Material | Cooled Magnetite material |
|---|---|---|---|---|
| NO (ppm) | 5.58 | 4.07 | 3.81 | 2.67 |
| SO2 (ppm) | 29.04 | 21.34 | 14.68 | 4.76 |
| CO (ppm) | 2258.76 | 1703.8 | 1276.79 | 567.65 |
| CO2 (%) | 5.54 | 4.37 | 3.83 | 2.44 |

Petrol Fuel Test Results with Magnetite Material:

| Gases Tested | No Magnetite Material | Cooled Magnetite Material |
|---|---|---|
| NO (ppm) | 7.43 | 2.48 |
| SO2 (ppm) | 90.61 | 35.25 |
| CO (ppm) | 3268.14 | 1788.34 |
| CO2 (%) | 5.65 | 2.92 |

Coal Fuel Test Results Compared to ROM with Magnetite Material at 20% Content:

| Gases Tested | No Magnetite Material Coal | 20% Magnetite Materia blended with ROM |
|---|---|---|
| NO (ppm) | 40.96 | 14.89 |
| SO2 (ppm) | 176.75 | 217.38 |
| CO (ppm) | 3834.16 | 3304 |
| CO2 (%) | 1.86 | 0.88 |

The invention claimed is:

1. A fuel composition for combustion, the fuel composition comprising:

a hydrocarbon-based fuel; and magnetite material comprising magnetite ($Fe_3O_4$), wherein:

the magnetite material is in the form of powder with a size range from 1 nm-5 mm;

the magnetite material is 0.1-80% (wt) of the fuel composition;

the magnetite material comprises at least 40% (wt) magnetite ($Fe_3O_4$);

the magnetite material is moisture-free;

the magnetite material comprises 0.001-1.5% (wt) silica (SiO2);

the magnetite material comprises at least 3.5 (wt) MgO;

the magnetite material comprises at least 2.4% (wt) TiO2; and a combustion performance measured as specific energy output and off-gases reduction of the fuel composition is non-linearly related to a proportion of the magnetite material.

2. The fuel composition as claimed in to claim 1, wherein the magnetite material is at least 2.5% (wt) of the fuel composition.

3. The fuel composition as claimed in claim 1, wherein the raw magnetite material includes $fe_2$+ and/or $fe_3$+ with a dominant north pole and is cooled and or is subjected to a magnetic field.

4. The fuel composition as claimed in claim 1, wherein the hydrocarbon-based fuel comprises one of more of:

coal, peat, lignite, slimes dam coal, charcoal, and/or anthracite;

a petroleum-based fuel comprising heavy fuel oil (HFO); and/or biomass, wood or wood pellets, opportunity fuels, biofuels, and/or bitumen.

5. The fuel composition as claimed in claim 1, wherein the hydrocarbon-based fuel is a liquid, and the magnetite material is a suspension or sediment.

6. The fuel composition as claimed in claim 1, wherein the hydrocarbon-based fuel includes one or more of:

tyre-derived fuel;

plastic waste fuel;

waste oil;

fly-ash; and recovered soot.

7. The fuel composition as claimed in claim 1, in which the magnetite material is recovered from a previous combustion event of the fuel composition, which converted at least some of the magnetite material to Fe2+ and/or Fe3+, wherein the fuel composition includes at least 10% wt of Fe2+ and/or Fe3+.

8. A combustion product comprising the fuel composition of claim 1, wherein:

the hydrocarbon-based fuel is a wax, comprises paraffin wax, and/or stearic acid;

the fuel composition is formed into a candle; and the combustion product includes a wick, the wick and the fuel composition both being involved in combustion.

9. A method of making the fuel composition as claimed in claim 1, the method including:

recovering magnetite material from a previous combustion event of the fuel composition;

mixing the hydrocarbon-based fuel with the recovered magnetite material for combustion; and repeating the above steps.

10. The method as claimed in claim 9, the method including cooling the recovered magnetite material for at least 1 hour at a temperature of at most 35° C. after the previous combustion event.

11. The method as claimed in claim 9, wherein:

the recovered magnetite material is a solid; and the method includes processing the solid magnetite material to produce the magnetite material by grinding it into a powder of less than 45 μm in size.

12. The method as claimed in claim 9, which further comprises mixing the recovered magnetite material with raw magnetite material which has not been previously combusted.

13. The method as claimed in claim 9, where the recovered magnetite material is applied/fed to a top surface of the hydrocarbon-based fuel.

14. The method as claimed in claim 9, wherein the recovered magnetite material is cooled and subjected to a magnetic field.

15. A method of making the fuel composition as claimed in claim 1, the method including:

providing container or conduit made of the magnetite material;

providing the hydrocarbon-based fuel in the container or conduit; and allowing at least some of the magnetite material from the container or conduit to leave or be removed from the container or conduit and mix with the hydrocarbon-based fuel, thereby to make the fuel composition.

16. A method of making the fuel composition as claimed in claim 1, wherein:

the hydrocarbon-based fuel is at least partially gaseous;

the gaseous hydrocarbon-based fuel is fed into a fluidised bed formation;

the magnetite material is recovered from a previous combustion event; and the gaseous hydrocarbon-based fuel comprises one or more of $CO_2$, CO, $SO_2$, and/or NO.

17. A method of preparing the fuel composition according to claim 1, wherein the magnetite material is subjected to a north pole magnetic field or after a combustion process resulting in a dominant south pole and greater fe2+ in the magnetite material, or where the magnetite material is subjected to a south pole magnetic field resulting with a dominant north pole all around and the fe3+ content increase in the magnetite material-based fuel.

18. A method of making the fuel composition as claimed in claim 1, where the magnetite material is bonded with a hydrocarbon fuel with bonding agent comprising a resin and is made into pellet or ball structure.

* * * * *